US005369235A

United States Patent [19]

Hendel

[11] Patent Number: 5,369,235

[45] Date of Patent: Nov. 29, 1994

[54] PROCESS FOR MANUFACTURING A CONTACTING DEVICE, CONTACTING DEVICE AND ITS USE

[75] Inventor: Horst Hendel, Berlin, Germany

[73] Assignee: Siemens Aktiengesellschaft, Munich, Germany

[21] Appl. No.: 849,406

[22] PCT Filed: Jun. 5, 1990

[86] PCT No.: PCT/DE90/00431

§ 371 Date: Apr. 23, 1992

§ 102(e) Date: Apr. 23, 1992

[87] PCT Pub. No.: WO91/06965

PCT Pub. Date: May 16, 1991

[30] Foreign Application Priority Data

Oct. 24, 1989 [DE] Germany ..... 3935773

[51] Int. Cl.[5] ..... H01H 1/06; H01H 11/04; B21D 39/00

[52] U.S. Cl. ..... 200/275; 200/283; 29/622; 29/514; 29/522.1

[58] Field of Search ..... 200/271, 283, 275, 239; 29/622, 514, 522.1

[56] References Cited

U.S. PATENT DOCUMENTS 3,930,211 12/1975 Belttary ..... 325/6
4,059,897 11/1977 Marquis ..... 29/522.1
4,647,743 3/1987 Kern et al. ..... 200/275

FOREIGN PATENT DOCUMENTS 0167668 1/1986 European Pat. Off. .
1083434 6/1960 Germany ..... 200/283
1665958 4/1971 Germany .
8109089 8/1981 Germany .

*Primary Examiner*—P. W. Echols
*Attorney, Agent, or Firm*—Hill, Steadman & Simpson

[57] ABSTRACT

An end (2) of an electrical connecting line (1) for feeding a switching current is connected in an electrically conductive fashion, engaging through a recess (4) of a contact support (3), to a contacting piece (7) arranged on the contact support (3).

In order to simplify the manufacture of such a contacting device, it is provided that the one end (2) is connected to an extension (10) which is formed by a stamping process in which the recess (4) of the contact support (3) is used as a shaping tool for the extension (10). It is thus ensured that the dimensions of the extension (10) are matched in an optimum fashion to the dimensions of the recess (4). In addition, due to the production of the extension (10) in the recess (4) itself, the positioning of the end (2) bearing the extension (10) relative to the contact support (3) or to its recess (4) is dispensed with.

The contacting device can be manufactured, in particular for switchgear and relays.

12 Claims, 2 Drawing Sheets

PROCESS FOR MANUFACTURING A CONTACTING DEVICE, CONTACTING DEVICE AND ITS USE

BACKGROUND OF THE INVENTION

The invention relates to a process for manufacturing a contacting device in which an end section of an electrical connecting line is guided to a first flat side of a leaf-shaped contact support, led through a recess of the contact support and connected in an electrically conductive fashion to a contacting piece on the second flat side of the contact support lying opposite. In addition, the invention relates to a correspondingly designed contacting device and a use of this contacting device.

From the German Registered Utility Model 81 09 089 a contacting device is already known which is manufactured in the way mentioned at the beginning. In this publication, for the purpose of feeding a switching current from one side of the contact support engaging through a recess of the contact support constructed as a punch-through, one end of an electrical connecting line is connected in an electrically conductive fashion to a contacting piece on the other side of the contact support. The one end of the electrical connecting line and the recess of the contact support, respectively, have to be exactly matched to one another in their dimensions in order to permit the one end to be fed through the recess in a fashion which is as free of play as possible and yet as simple as possible. In particular when manufacturing relatively small contacting devices, the positioning of the one end relative to the recess of the contact support is difficult and causes an additional production expenditure which contributes to the production costs. In the case of changes to the dimensions of the recess of the contact support, whether they be constructionally necessary changes or due to tool wear, matching of the tool which manufactures the one end is required.

European reference 0,167,688 (corresponding to U.S. Pat. No. 4,647,743) already discloses a contacting arrangement in which a connecting line in the form of a stranded conductor is connected directly to a contacting piece. This publication is particularly concerned with the problem that the contact support in the form of a central contact spring is to be provided on both sides with a contacting piece. In order to cold weld the connecting stranded conductor it is therefore proposed in this publication to allow one of the contacting pieces to extend over the width of the contact spring end and to cold weld the stranded conductor to the protruding part. The second contacting piece is constructed in this publication as a contacting rivet with a round cross-section which is connected by a corresponding projection, engaging through a hole of the spring, to the elongate contacting piece first mentioned. These round contacting pieces require a relatively high degree of production expenditure; in addition, there is the risk that the two associated contacting pieces are rotated in the hole of the contact spring by tensional forces on the stranded conductor, as a result of which the position of the elongate contacting piece in relation to its corresponding contacting element would change.

SUMMARY OF THE INVENTION

The object of the invention is to provide a process of the type mentioned at the beginning and a corresponding contacting device which is as easy and economical to manufacture as possible, in which case in particular a direct connection of a connecting line both in a single contact to the contacting piece of the contact support and in a switch contact to both contacting pieces of a central contact spring is possible, and contacting pieces which are as economical as possible can be used.

According to the invention, the object relating to the process is achieved in that the end section of the connecting line is placed with a pressed-flat longitudinal side parallel on the first flat side of the contact support, covering the recess on all sides, in that an extension is stamped out of the end section of the connecting line perpendicularly to the flat side through the recess of the contact support and in that during the stamping process the contact support itself serves as a shaping tool with the contour of the recess.

Since the recess of the contact support is used as a shaping tool for the stamping process for manufacturing the extension, the extension formed in this way is always matched exactly to the dimensions of the recess of the contact support, even if these dimensions should vary during a production batch. In addition, changes to the geometry of the recess are possible over wide areas without costs arising for a change of a tool producing the extension. A further advantage of the process according to the invention consists in the fact that after the stamping process the extension already engages through the recess of the contact support in a fashion which is free of play and non-positively engaging and thus additional production steps for the positioning of the extension relative to the recess and for feeding through and fixing the extension are dispensed with. It is also advantageous that no exactly prestamped contacting rivets with a cross-section matched to the recess of the contact support have to be used. Cost-effective cold welded contacts can thus be used which are simply cut off the tape and cold welded on.

In the process according to the invention, the internal circumferential walls of the recess in the contact support extend perpendicular to their flat sides so that the extension also assumes the shape of a column with circumferential walls extending perpendicular to the flat sides. An undercut or conical design of the bore in the contact support, as in the known extrusion riveting of contacting pieces, is not required here, since the contacting piece is of course connected to the extension from the opposite side. With respect to the transport of the semi-finished product during the following production steps, in particular up to the connection of the contacting piece to the extension, it may be advantageous to connect the extension to the contact support after the stamping process. This can occur by means of a simple soldering; however other Joining methods, for example bonding, are also conceivable. In addition, in a post-stamping process a further shaping of the extension can be performed such that the extension extends in a rivet head-like fashion outside the recess in order to form a positively-engaging connection. The recess preferably has a noncircular cross-section; by means of a cross-section of, for example, corner-shaped construction a rotational movement of the extension in the recess is reliably prevented. Thus, the extension is prevented from moving relative to the recess or from slipping out of the recess of the contact support.

Furthermore, it is expedient that the end section of a connecting line constructed as a stranded conductor is compressed in a plate shape before being applied to the contact support, in which case, for example, the individual conductors of the stranded conductor are cold welded. In this way, a particularly exact geometry of the extension can be achieved because the compressed material of the connecting line can be stamped better. This is particularly advantageous if the extension is to protrude on the second flat side lying opposite.

It is particularly cost-effective if a plurality of contacting devices are manufactured in series production and initially a continuous length of connecting lines with alternately non-compressed and compressed conductor sections is manufactured, in each case a compressed section is then applied as end section of a first connecting line to a contact support and stamped into the recess and finally a protruding portion is cut off the stamped section which forms an initial section of a further connecting line. This considerably simplifies the handling of large numbers because during the stamping process the connecting lines of a plurality of successive contacting devices are still Joined and thus do not have to be transported as individual pieces.

In addition, according to the invention a contacting device with a contact support in the form of a leaf spring which has a recess, a connecting line arranged on a first flat side of the support and a contacting piece which is arranged on the second flat side of the support and connected in an electrically conductive fashion to a section of the connecting line led through the recess, is provided in which the connecting line lies with a plate-shaped end section on the first flat side of the support, in which an extension is stamped out of the plate-shaped end section perpendicularly to the flat side of the support, extends through the recess at least over the entire thickness of the support and is connected to the contacting piece on the second flat side of the support. Preferably, the recess of the contact support has a non-round cross-section as does the extension of the connecting line. In this way, twisting of the extension and of the contacting pieces connected to the connecting line is reliably avoided, which is important particularly in the case of elongate solder contacts.

If, in addition, the surface of the end section of the connecting line facing away from the contact support is provided with a second contacting piece, it is expedient that this plate-shaped end section decreases in thickness in a wedge shape towards the free end of the support. Thus, the angular movement of the contact support, that is to say, for example, of a contact spring connected to an armature, can be allowed for. If in fact the respective corresponding contact elements are located parallel to one another, this wedge-shaped arrangement of the contacting pieces on the end section of the connecting line can ensure that the respective contacting piece in the respective switching position is also located parallel to the corresponding contact element.

BRIEF DESCRIPTION OF THE DRAWINGS.

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
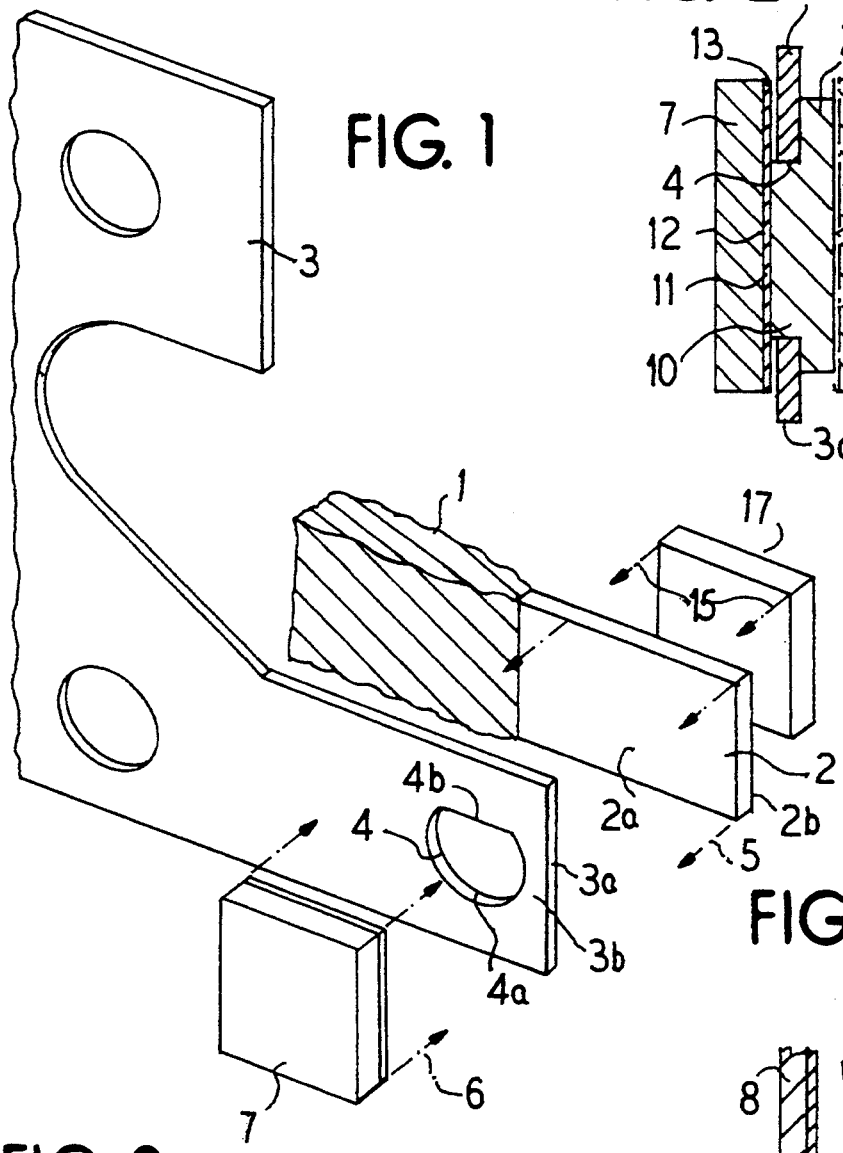
FIG. 1 shows components of a contacting device, manufactured in accordance with the process according to the invention, in the unassembled state.

FIG. 1 shows an electrical connecting line 1 in the form of a copper stranded conductor as a component of a contacting device, the said conductor having an end section 2 compressed by means of a cold welding process. A contact support 3 of the contacting device is provided with a recess 4. The recess 4 has a circular cross-section which is reduced by one segment. In the course of a joining process by means of a stamping tool not shown in FIG. 1, the end section 2 of the electrical connecting line 1 is guided towards the one flange side 3*a* of the contact support 3 in the direction of the arrows 5; in the same way, a contacting piece 7 is guided towards the opposite flat side 3*b* of the contact support 3, as shown by arrows 6. In addition, a second contacting piece 17 can be placed on the flat side 2*b* of the end section, as shown by the arrows 15.

Figure 2:
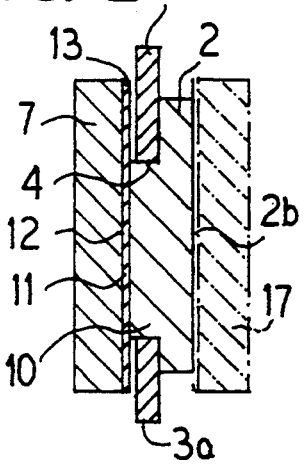
FIG. 2 shows a contacting device manufactured in accordance with the process according to the invention, in section.

FIG. 2 shows the components of the contacting device according to FIG. 1 in the assembled state after the stamping process. The one end 2 of the electrical connecting line 1 has an extension 10 which is stamped out of the flat side 2a perpendicularly to the surface, which engages through the recess 4 of the contact support 3 and is cold welded on its end face 11 to the contacting piece 7 forming an electrical connection 12. During the stamping process, the circular cross-section 4*a* of the recess 4 which is reduced by one segment 4*b* causes the extension 10 to be constructed in the forth of a cylinder with a corresponding flattening of its outer surface. As a result, a twisting of the extension 10 in the recess 4 is prevented. In order to improve the electrical conductivity of the connection 12 the contacting piece 7 is plated with a silver layer 13. The contacting device produced in this way can be, for example, part of a relay, as described in general in the German Registered Utility Model 83 25 986 with its magnet system. In this publication, the armature of the relay would be connected to the contact support 3 constructed as a contact spring. It is also conceivable to insert the illustrated contacting device according to FIG. 2 in a change-over contact arrangement, the contacting piece 17, which is illustrated in FIG. 2 by dot-dash lines, being connected in an electrically conductive fashion to the flat side 2*b* of the end section 2 of the electrical connecting line 1 facing away from the extension 10. The cold welded face formed by the side 2*b* is constructed during the stamping process in such a way that it is ensured that the quality of the electrical connection to the contacting piece 17 corresponds to that of the connection 12.

Figure 3:
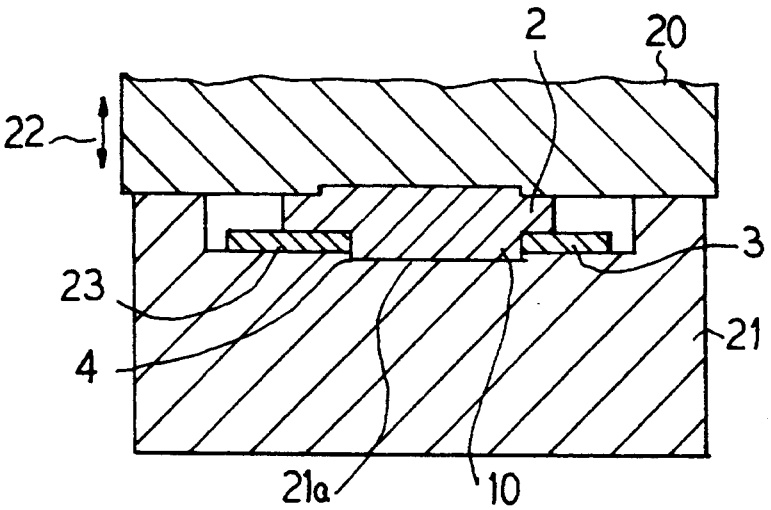
FIG. 3 shows a tool used for carrying out the process according to the invention.

FIG. 3 shows a tool which can be used for manufacturing the contacting device and consists of an upper part in the form of a punch 20 and of a receiving element 21 cooperating with this punch. The punch 20 can be moved in the vertical direction 22 and can be lowered with a pressure sufficient for deforming, for example, an electrical connecting line constructed as a copper stranded conductor. The end section 2 of the electrical connecting line 1 and the contact support 3, at least with its area having the recess 4, are inserted into this tool. By means of the pressure generated by the punch 20, the material of the end section 2 is shaped by engaging through the recess 4 of the contact support 3 with the formation of the extension 10. The receiving element 21 has a slight depression 21*a* with circular cross-section, the diameter of the said depression being roughly matched to the recess 4. If the diameter of the depression 21*a* is greater in dimension than the recess 4 with an essentially circular cross-section, the material of the end section 2 flows in accordance with the depression 21*a* after the actual stamping process so that a rivet head-like, positively-engaging fixing of the extension 10 in the recess 4 is provided. The extension 10 formed in this way extends through a plane 23 formed by the lower face of the contact support 3 in accordance with FIG. 3 and projects above the contact support 3 on this side. The receiving element 21 can serve at the same time as a cold welded tool for producing a cold welded connection to the contact support 3 by means of electrical resistance cold welding, the said cold welded connection fixing the extension 10 in the recess 4. In order to complete this arrangement to form a contacting device in accordance with FIG. 1 or 2, a contacting piece 7 or 17 is applied in an electrically conductive fashion on one side or on both sides to the extension 10 or to the side of the end section 2 of the electrical connecting line 1 facing away from the extension 10. With corresponding construction of the punch 20 or of the receiving element 21, this can occur directly after the stamping process.

Figure 4:
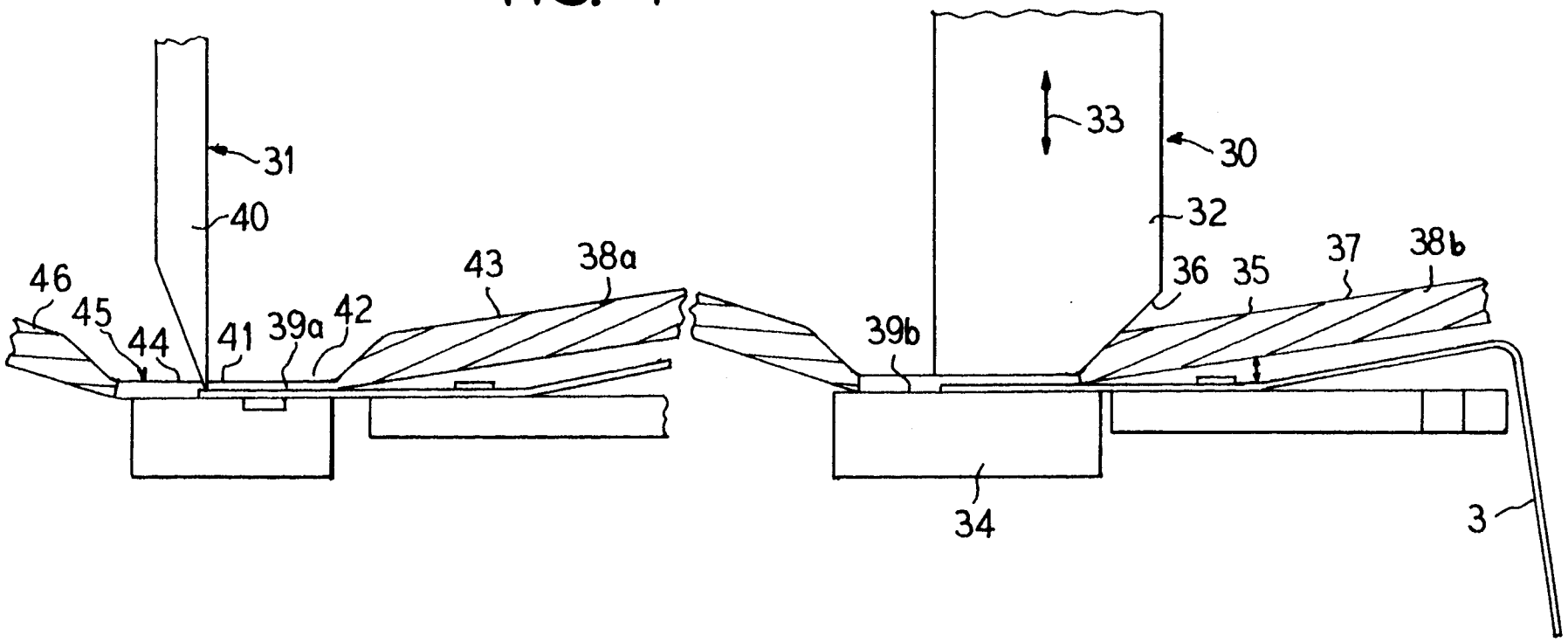

FIG. 4 shows diagrammatically a process for the successive manufacture of a plurality of contacting devices (series production), one stamping process step 30 and one cutting process step 31 being illustrated in detail as process steps. A punch 32 can be moved up and down in the vertical direction 33 and forms with a receiving element 34 a stamping tool in accordance with FIG. 3. The punch 32 has an incline 36 so that the electrical connecting line 1 can move away from the contact support 3 at a predeterminable angle 35. A length 37 has alternately non-compressed sections 38*a*, 38*b* and compressed sections 39*a*, 39*b*. If required, after further work stations the cutting process step 31 follows in the course of the series production, with which step the compressed section 39*a* of the length 37 is cut by means of a cutting device 40. A first portion 41 of the compressed section 39*a* is formed which forms the end section 42, provided with the extension, of an electrical connecting line 43 which is produced complete when the section 39*b* of the length 37, which is compressed directly afterwards, is cut in the same fashion. A second portion 44, formed by cutting, of the compressed section 39*a* forms an initial section 45 of a further electrical connecting line 46 of a preceding contacting device (not illustrated in more detail), the said initial section 45 serving for the external connection of this electrical connecting line 46.

Figure 5:
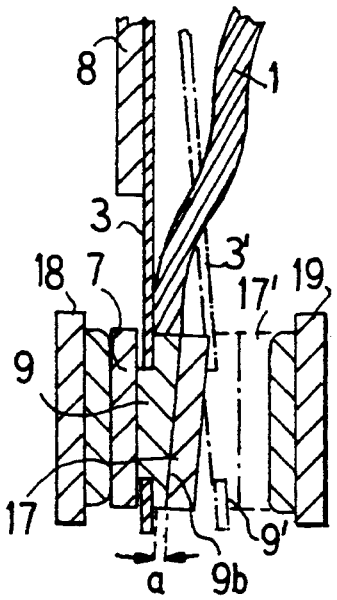
FIG. 4 shows a diagrammatic illustration of the execution of the process according to the invention in the form of series production and FIG. 5 shows a contact support as a central contact spring in longitudinal section with contacting pieces arranged in a wedge shape.

In FIG. 5, a modified embodiment of the contacting device is shown. The contact support 3 is illustrated in a lateral sectional view in the form of a contact spring connected to an armature 8. The compressed end section 9 of the connecting stranded conductor 1 is shaped in this case so as to run towards the free end in a wedge shape, which is indicated by the angle $\alpha$ drawn in exaggerated form. Accordingly, the contacting pieces 7 and 17 cold welded onto the extension 10 or onto the rear 9*b* of this end section also form a gentle angle with respect to one another. This angle is matched to the angular movement of the armature 8 and, with the customary dimensions and contact spaces, is approximately of the order of magnitude of up to 5°. By means of this wedge-shaped design it is possible for the respective contacting piece to be located in every switching position in each case approximately parallel to the associated corresponding contact element. In the present example, the contact piece 7 is thus essentially parallel to the corresponding contact element 18. If the armature is swiveled into the second switching position, the contact spring assumes the position 3' whilst the contacting piece 17 or 17' is now located parallel to the corresponding contact element 19.

By means of the described process, a contacting device can be provided in a simple fashion, in which device an extension of one end of an electrical connecting line is matched in an optimum fashion to a recess of a contact support, in that the recess itself serves as a tool for manufacturing the extension. Already during production, the extension is correctly inserted and positioned in the recess and with a construction of the stamping tool (receiving element) as described above is connected to the contact support in a positively-engaging fashion and thus forms a constructional unit which is easy to handle during the further production process.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. A process for manufacturing a contacting device comprising the steps of: guiding an end section of an electrical connecting line to a first flat side of a leaf-shaped contact support, forcing the end section through a recess of the contact support and connecting the end section in an electrically conductive fashion to a contacting piece on a second flat side lying opposite the first flat side, the end section of the connecting line being placed parallel with a pressed-flat longitudinal side on the first flat side of the contact support, covering the recess on all sides, an extension being stamped out of the end section of the connecting line perpendicularly to the first flat side through the recess of the contact support, and during the stamping process the contact support serving as a shaping tool with a contour of the recess.

2. The process as claimed in claim 1, wherein the extension is connected to the contact support after the stamping process.

3. The process as claimed in claim 1, wherein the end section of a connecting line i.e. a stranded conductor and is compressed in a plate shape before being applied to the contact support.

4. The process as claimed in claim 1, wherein the recess in the contact support is preformed with circumferential walls extending essentially perpendicularly to the first and second flat sides.

5. The process as claimed in claim 4, wherein during a series production of contacting devices, a continuous length of connecting lines with alternately non-compressed and compressed sections is initially manufactured, wherein a compressed section is then placed as end section of a first connecting line on a contact support and stamped into the recess, and wherein a protruding portion is then cut off the compressed section which portion forms an initial section of a further connecting line.

6. The process as claimed in claim 4, wherein a free surface of the end section facing away from the contact support is connected directly to a second contacting piece.

7. The process as claimed in claim 3 during a series production of contacting devices, a continuous length of connecting lines with alternately non-compressed and compressed sections is initially manufactured, wherein a compressed section is then placed as end section of a first connecting line on a contact support and stamped into the recess, and wherein a protruding portion is then cut off the compressed section which portion forms an initial section of a further connecting line.

8. The process as claimed in claim 3, wherein a free surface of the end section facing away from the contact support is connected directly to a second contacting piece.

9. A contacting device comprising a contact support in the form of a leaf spring which has recess, a connecting line arranged on a first flat side of the support and a contacting piece arranged on a second flat side of the support, the contacting piece being electrically connected to a section of the connecting line forced through the recess, the connecting line lying with a plate-shaped end section on the first flat side of the support, an extension being stamped out of the plate-shaped end section perpendicularly to the first flat side of the support and extending through the recess at least over the entire thickness of the support and connected to the contacting piece on the second flat side of the support.

10. The contacting device as claimed in claim 9, wherein the recess of the support and the extension of the connecting line have a cross-section which is non-round to the same degree.

11. The contacting device as claimed in claim 10, wherein the plate-shaped end section of the connecting line decreases in thickness in a wedge shape in a direction of a free end of the support.

12. The contacting device as claimed in claim 9, wherein the contacting device is arranged in an electromagnetic relay, the contact support being connected as a central contact spring to a change-over contact arrangement with a swivellable armature in the electromagnetic relay.

* * * * *